US009957753B2

(12) United States Patent
Amsellem

(10) Patent No.: US 9,957,753 B2
(45) Date of Patent: May 1, 2018

(54) SCREEN PANEL FOR ROLL-UP DOORS

(71) Applicant: Daniel Amsellem, Fort Worth, TX (US)

(72) Inventor: Daniel Amsellem, Fort Worth, TX (US)

( * ) Notice: Subject to any disclaimer, the term of this patent is extended or adjusted under 35 U.S.C. 154(b) by 0 days. days.

(21) Appl. No.: 15/088,120

(22) Filed: Apr. 1, 2016

(65) Prior Publication Data

US 2016/0290037 A1 Oct. 6, 2016

Related U.S. Application Data

(60) Provisional application No. 62/141,608, filed on Apr. 1, 2015.

(51) Int. Cl.

| | |
|---|---|
| ***E06B 3/48*** | (2006.01) |
| ***E06B 9/52*** | (2006.01) |
| *E05D 13/00* | (2006.01) |
| *E06B 5/00* | (2006.01) |

(52) U.S. Cl.

CPC ..... *E06B 9/52* (2013.01); *E06B 3/485* (2013.01); *E05D 13/00* (2013.01); *E06B 5/003* (2013.01); *E06B 2009/527* (2013.01); *E06B 2009/528* (2013.01)

(58) Field of Classification Search

CPC ..... E06B 2009/527; E06B 2009/528; E06B 9/52; E06B 5/03; E06B 3/485; E06B 5/003; E06B 7/05; E06B 7/04

USPC ..... 49/197, 199, 62, 63, 65, 315, 126, 200, 49/147, 198, 61, 125, 143, 201; 160/115, 160/201, 211, 220, 222

See application file for complete search history.

(56) References Cited

U.S. PATENT DOCUMENTS 1,282,146 A * 10/1918 Tomkinson ..... 160/202
1,606,977 A * 11/1926 Tomkinson ..... E05D 15/583 160/190
2,314,634 A * 3/1943 Robinson ..... E05D 15/425 49/206
3,218,091 A * 11/1965 Doak ..... B60P 3/32 160/222
4,378,043 A * 3/1983 Sorenson ..... E06B 7/03 160/201
4,653,566 A * 3/1987 Miale ..... E06B 9/54 160/113
5,611,382 A * 3/1997 Sferra ..... E06B 9/52 160/113
5,727,614 A * 3/1998 Lichy ..... E06B 9/581 160/201
5,860,465 A * 1/1999 Eastridge ..... E06B 3/485 160/113
5,904,199 A * 5/1999 Messner ..... E06B 7/03 160/127

(Continued)

*Primary Examiner* — Katherine W Mitchell
*Assistant Examiner* — Jeremy C Ramsey
(74) *Attorney, Agent, or Firm* — Lightfoot & Alford PLLC

(57) ABSTRACT

A screen panel for a roll-up door is configured to be slidably coupled to the door adjacent a bottom portion of the door. The panel is generally parallel to the bottom portion when installed and movable between a retracted position, wherein a bottom edge of the panel is generally aligned with a bottom edge of the door, and an extended position, wherein the bottom edge of the panel is located below the bottom portion. A biasing device biases the panel toward the retracted position with a biasing force that is sufficient to move the panel to the retracted position only when the panel is positioned in an orientation other than a vertical orientation.

21 Claims, 10 Drawing Sheets

(56) References Cited

U.S. PATENT DOCUMENTS

| | | | | |
|---|---|---|---|---|
| 6,092,580 | A * | 7/2000 | Lucas | E06B 3/485 160/113 |
| 6,557,614 | B1 * | 5/2003 | Lampers | E06B 9/52 160/113 |
| 6,705,378 | B1 | 3/2004 | Smidt | |
| 7,143,803 | B2 * | 12/2006 | Mitchell | E06B 7/02 160/113 |
| 8,439,098 | B1 | 5/2013 | Jones et al. | |
| 9,512,668 | B1 * | 12/2016 | Nissan | E06B 9/06 |
| 2009/0084507 | A1 * | 4/2009 | Tescher | E06B 3/485 160/44 |
| 2011/0073262 | A1 * | 3/2011 | Frede | E06B 9/62 160/309 |
| 2011/0315328 | A1 | 12/2011 | Hazel | |

* cited by examiner

SCREEN PANEL FOR ROLL-UP DOORS

CROSS-REFERENCE TO RELATED APPLICATIONS

This patent application claims the benefit of the filing date of the U.S. Provisional Patent Application Ser. No. 62/141,608, filed on 1 Apr. 2015 and titled SCREEN PANEL FOR ROLL-UP DOORS, the entire content of which is hereby expressly incorporated by reference.

BACKGROUND

To ventilate a garage or similar structure enclosed by a roll-up door, a user can open the door a small amount, which promotes ventilation while preventing humans and large animals from entering. However, smaller pests, such as insects, rodents or reptiles, can easily enter under a partially-opened roll-up door.

DETAILED DESCRIPTION

Illustrative embodiments are described below. In the interest of clarity, not all features of an actual implementation are described in this specification. In the development of any such actual embodiment, numerous implementation-specific decisions must be made to achieve the developer's specific goals, such as compliance with system-related and business-related constraints, which will vary from one implementation to another. Moreover, such a development effort might be complex and time-consuming but would nevertheless be a routine undertaking for those of ordinary skill in the art and having the benefit of this disclosure.

In the specification, reference may be made to the spatial relationships between various components and to the spatial orientation of various aspects of components as the devices are depicted in the attached drawings. However, as will be recognized by those skilled in the art after a complete reading of this patent application, the devices, members, apparatuses, etc. described herein can be positioned in any appropriate orientation. Thus, the use of terms to describe a spatial relationship between various components or to describe the spatial orientation of aspects of such components should be understood to describe a relative relationship between the components or a spatial orientation of aspects of such components.

FIGS. 1 through 12 show preferred and alternative embodiments of a screen panel for use with a roll-up door, the screen panel allowing for passive operation in addition to manual operation. While a typical sectional garage door for a residence is shown in the figures, it should be understood that the screen panel is also useful with commercial sectional doors and can be fitted to other types of roll-up doors, such as roller (sheet) doors.

Figure 1:
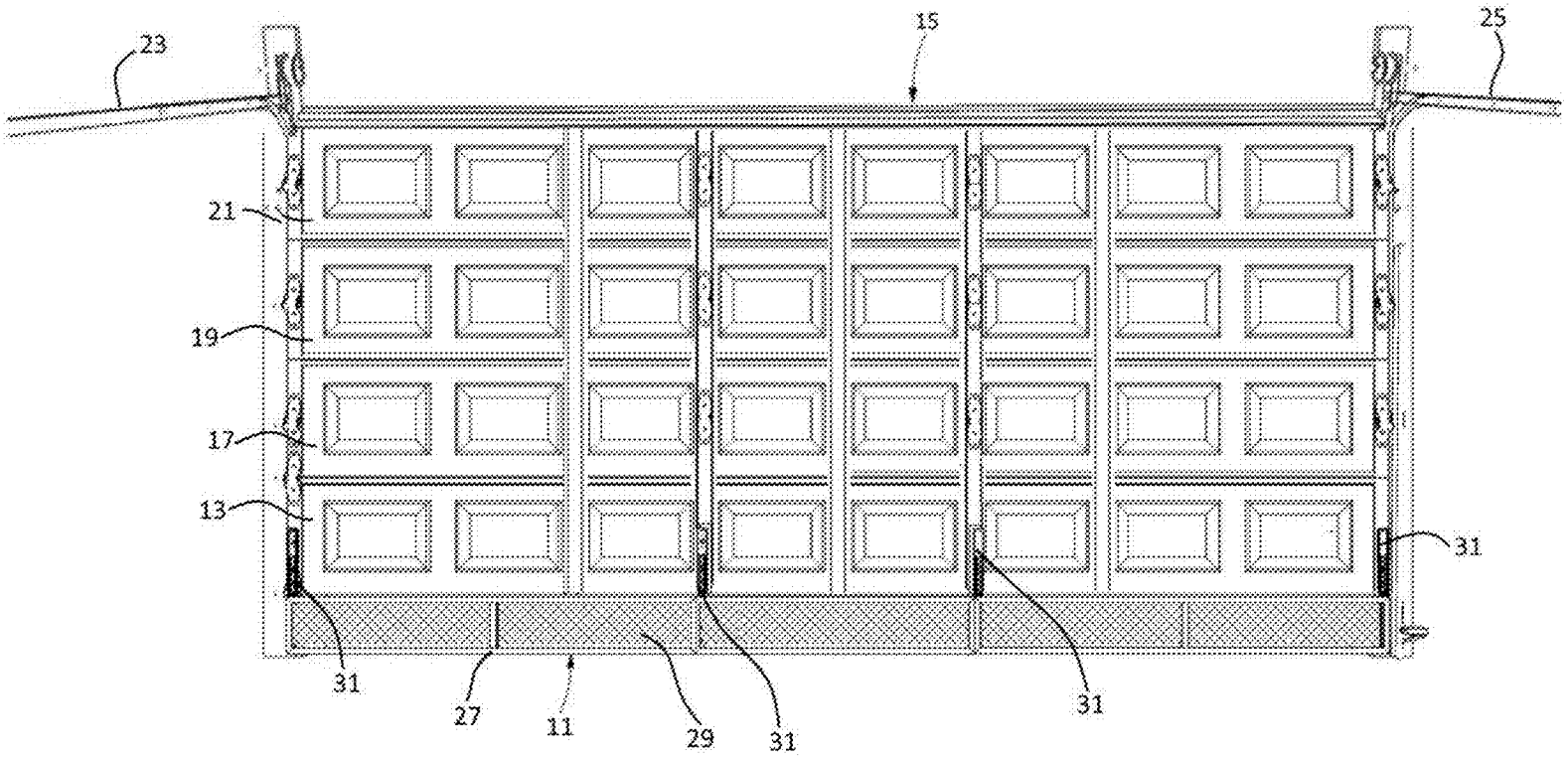
FIG. 1 is a perspective view of a garage door having an embodiment of a screen panel installed.
Figure 2:
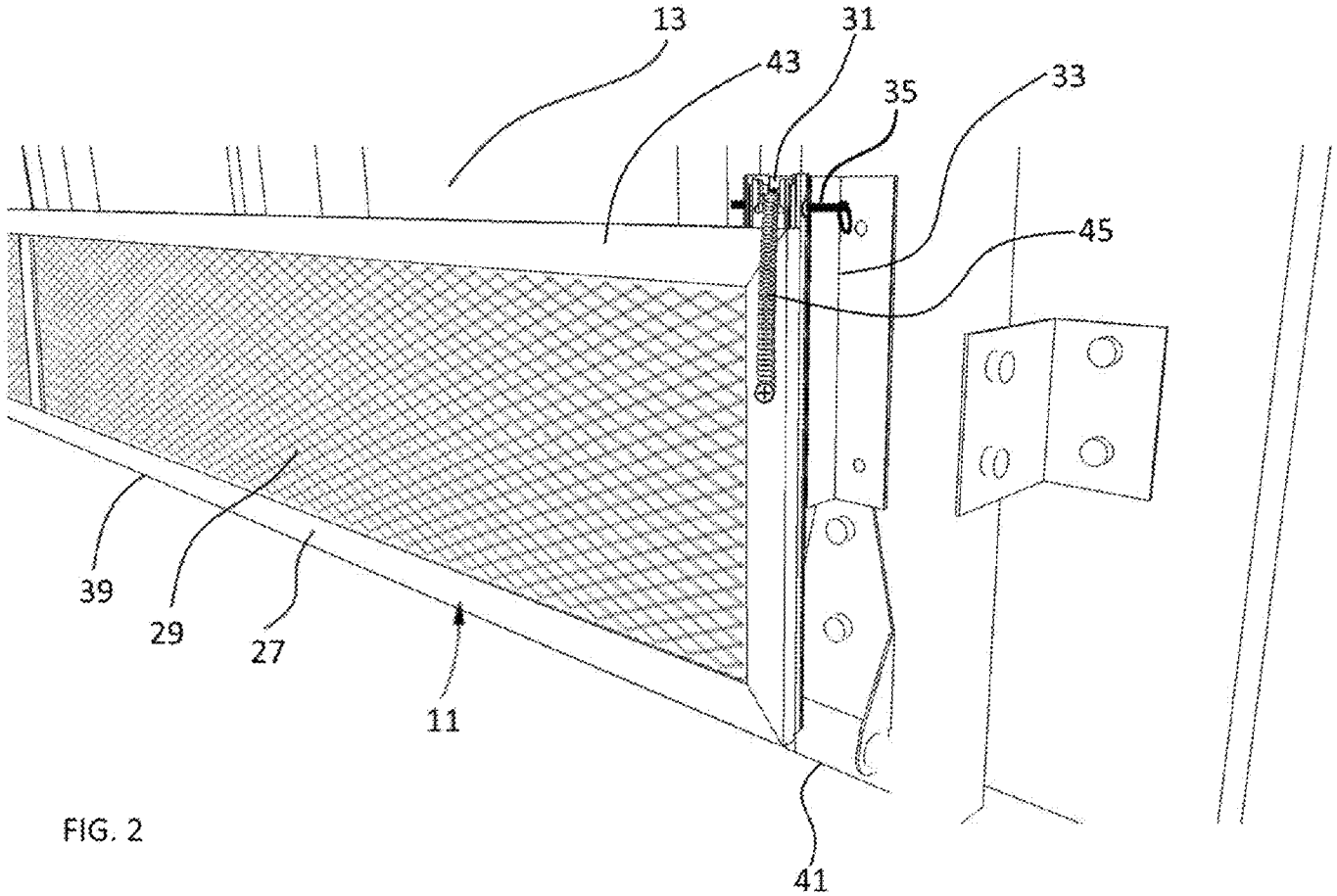
FIG. 2 is a perspective view of a portion of the door and screen panel assembly of FIG. 1, the door being in a closed position.
Figure 3:
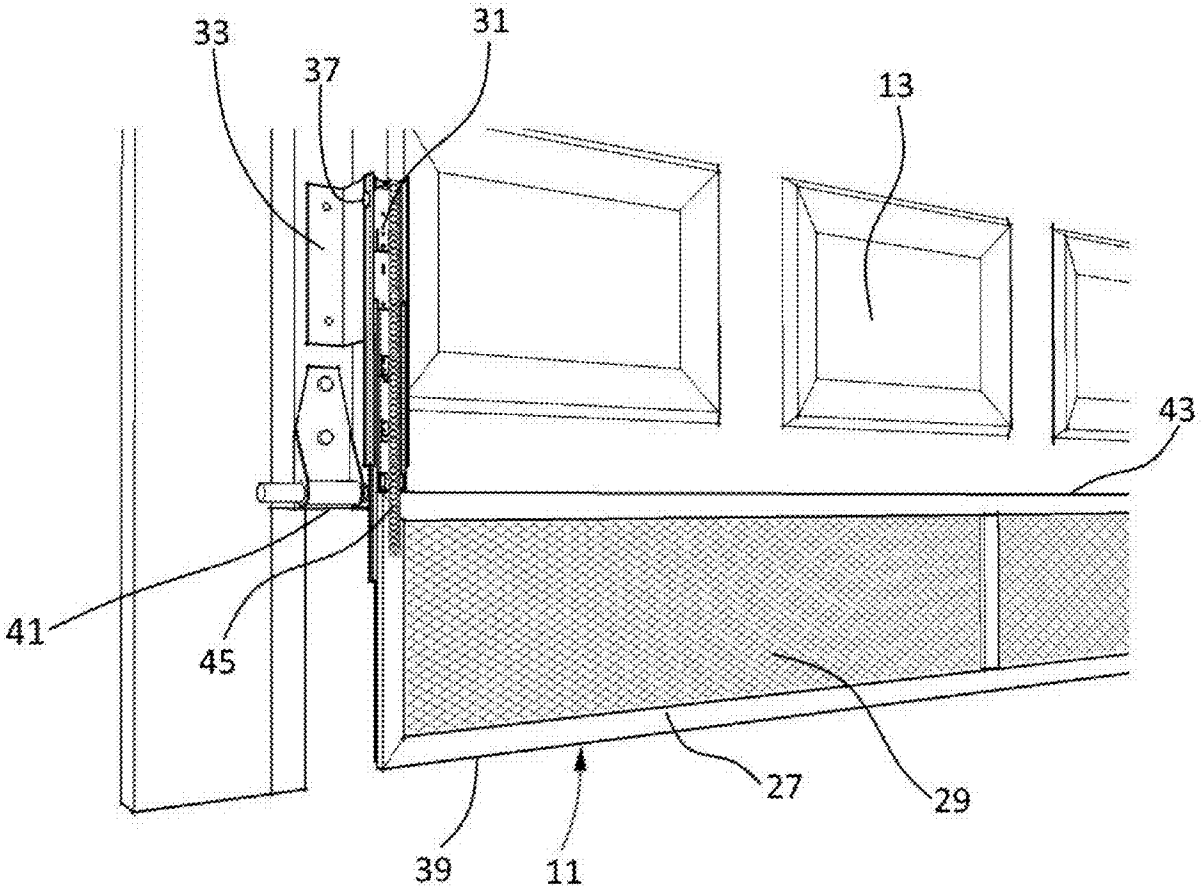
FIG. 3 is a perspective view of another portion of the door and screen panel assembly of FIG. 1, the door being in a partially open position.

Referring to FIGS. 1 through 4, a screen panel 11 is mounted to a bottom section 13 of a sectional door 15, which comprises additional upper sections 17, 19, 21. Sections 13, 17, 19, 21 are hingedly joined to each other for movement together along tracks 23, 25. As door 15 is raised from a closed position, as shown in FIG. 1, toward an open position, sections 13, 17, 19, 21 sequentially rotate from a vertical orientation to a generally horizontal orientation as rollers on sections 13, 17, 19, 21 follow tracks 23, 25.

Panel 11 comprises a frame 27 that is preferably formed from a lightweight material, such as aluminum or a polymer, and is a rigid, planar, windowed structure. Screen 29, or a similar material allowing air to easily pass through, is installed on frame 27 for covering the openings in frame 27. Frame 27 is preferably formed as a panel with one or more openings, and panel 11 can comprise one or more separate frames 27 to span the width of door 15. While shown as having a selected height, panel 11 can be formed to have an adjustable height.

Figure 4:
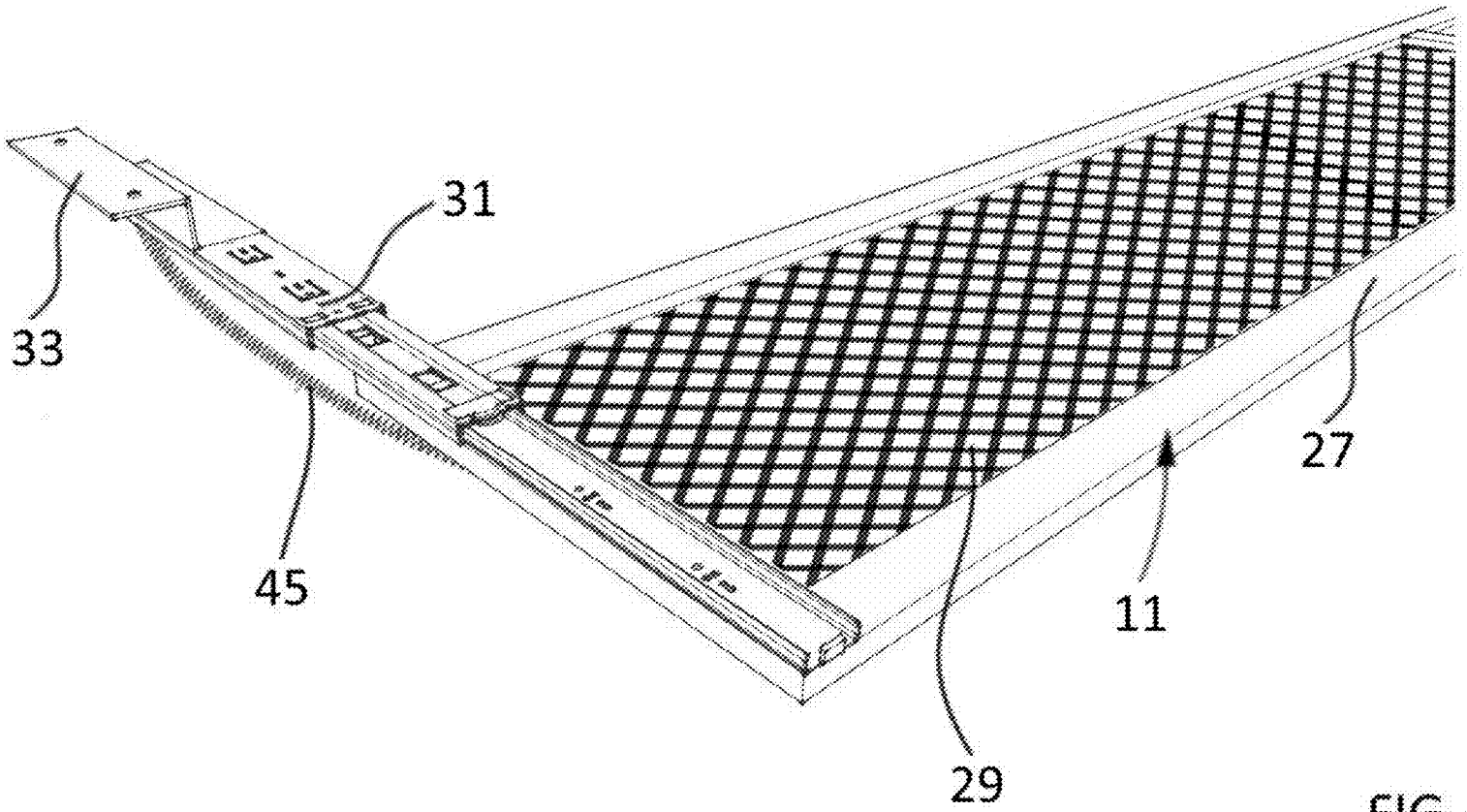
FIG. 4 is a perspective view of a portion of the screen panel of FIG. 1, a telescoping slider being shown in an extended position.
Figure 5:
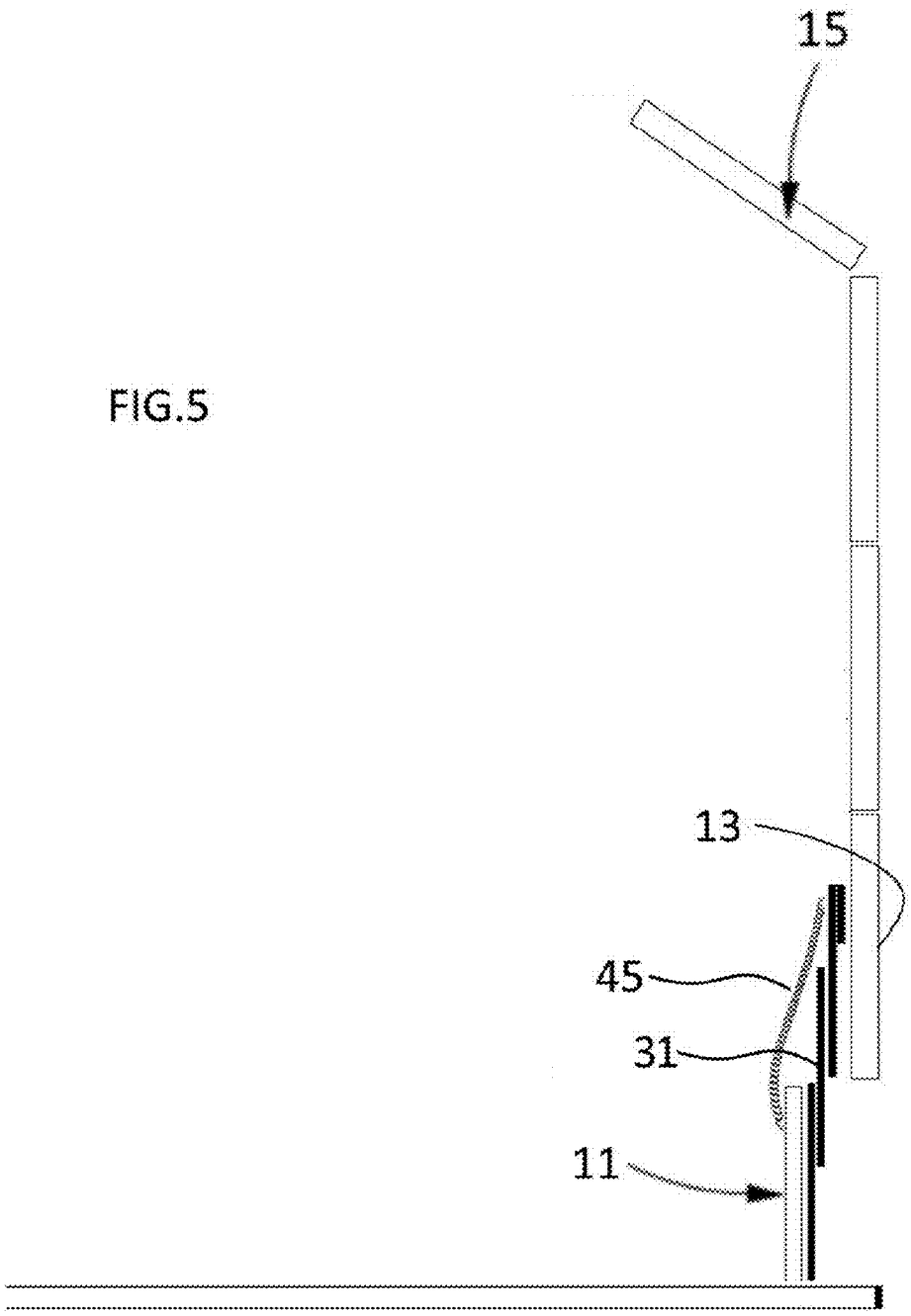
FIGS. 5 through 8 are sequential images showing the door and screen panel assembly of FIG. 1 moving from a partially open position to an fully open position, the screen panel moving relative to the door from an extended position to a retracted position.
Figure 6:
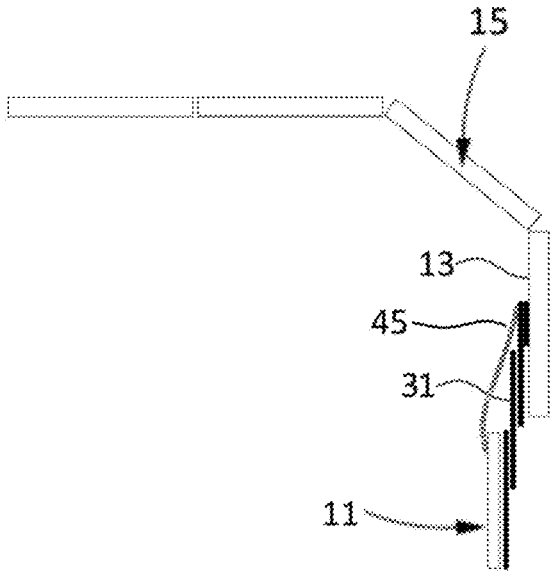
Figure 7:
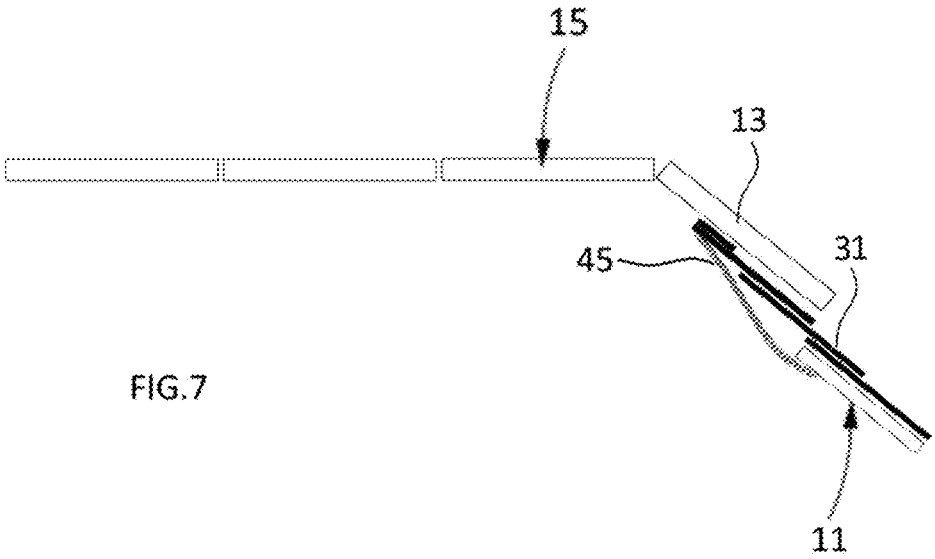

In the embodiment shown, panel 11 is coupled to bottom section 13 with telescoping sliders 31, which are shown in detail in FIG. 4. Sliders 31 can be placed at various locations along the width of section 13, and sliders 31 maintain panel 11 in a generally parallel orientation relative to section 13. When installed, sliders 31 allow panel 11 to move a limited amount relative to bottom section 13, with panel 11 being moveable between a retracted position, shown in FIGS. 1 and 2, and an extended position, shown in FIG. 3. Sliders 31 are attached to bottom section 13 with brackets 33, and a locking device, such as pin 35, can be engaged to place panel 11 in a fixed condition in the retracted position. In the fixed condition, panel 11 is fixed in relative position to section 13, and panel 11 moves together with door 15. To lock panel 11, pin 35 is inserted into hole 37, whereas removing pin 35 places panel 11 in a released condition, allowing panel 11 to move relative to section 13. Pin 35 can be configured as manually operated or can be motorized for remote operation.

In the retracted position, panel 11 is positioned relative to bottom section 13 so that bottom edge 39 of panel 11 is generally aligned with a bottom edge 41 of bottom section 13. In the fully extended position, bottom edge 39 of panel 11 hangs below bottom edge 41 of section 13, but upper edge 43 of panel 11 is aligned with or above bottom edge 41 of section 13. During use, panel 11 can be at the retracted position or extended position or can be at an intermediate position.

A spring 45, or other biasing device, biases panel 11 toward the retracted position. In the embodiment shown, spring 45 extends between panel 11 and the portion of slider 31 that is affixed to bracket 33 and non-moveable relative to section 13. Spring 45 has a selected spring force that provides a biasing force insufficient to overcome the force of gravity and move panel 11 to the retracted position when bottom section 13 is in a vertical orientation. However, spring 45 has sufficient biasing force to move panel 11 to the retracted position as section 13 is rotated toward a horizontal orientation. This allows bottom edge 39 of panel 11 to remain against a floor or other surface as door 15 is raised a selected amount. As door 15 is raised beyond the limited available travel of panel 11 relative to bottom section 13, then panel 11 moves upward with section 13.

Figure 8:
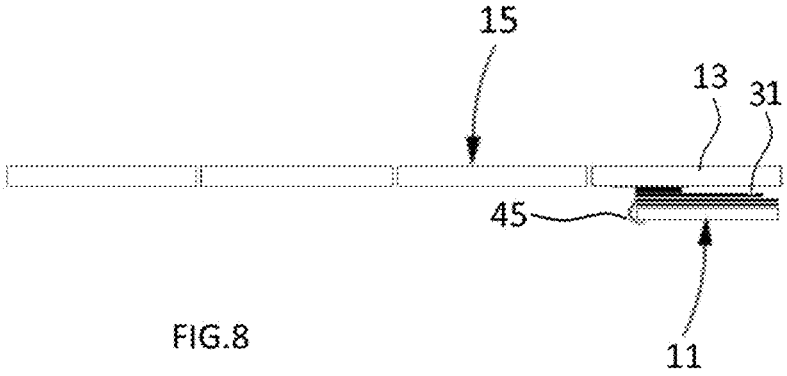

FIGS. 5 through 8 show door 15 being raised from the partially open ventilation position, with panel 11 in the extended position, to a fully open position. Panel 11 remains in the extended position until section 13 is rotated to an orientation between that of FIGS. 7 and 8. In FIG. 8, panel 11 is shown as having been retracted once the biasing force of spring 45 is greater than that necessary to retract panel 11, and this occurs during rotation of section 13 due to the decrease of the opposing force of gravity in the direction of travel of panel 11.

Figure 9:
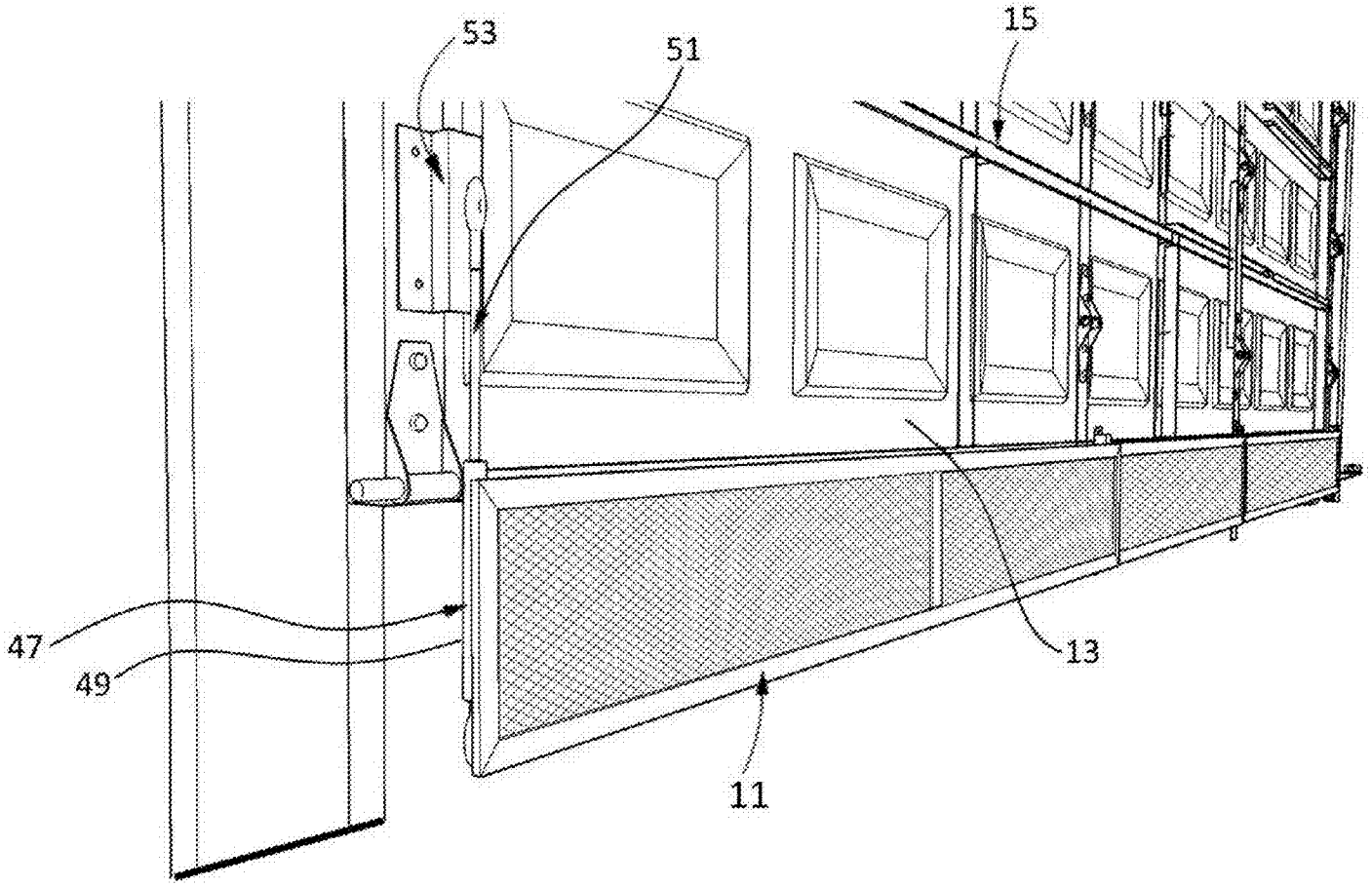
FIG. 9 is a perspective view of a portion of a garage door having an alternative embodiment of a screen panel installed.

FIG. 9 shows an alternative embodiment, in which panel 11 is coupled to door 15 with pneumatic struts 47. Struts 47 comprise a body 49 and a telescoping shaft 51, with body 49 connected to panel 11 and shaft 51 connected to bottom section 13 with bracket 53. Struts 47 replace both sliders 31 and spring 45 in the previous embodiment, as struts 47 maintain the generally parallel orientation of panel 11 relative to section 13 and act as a biasing device to provide the required biasing force, as described above for spring 45, to cause panel 11 to move to the retracted position as section 13 rotates toward the horizontal orientation.

Figure 10:
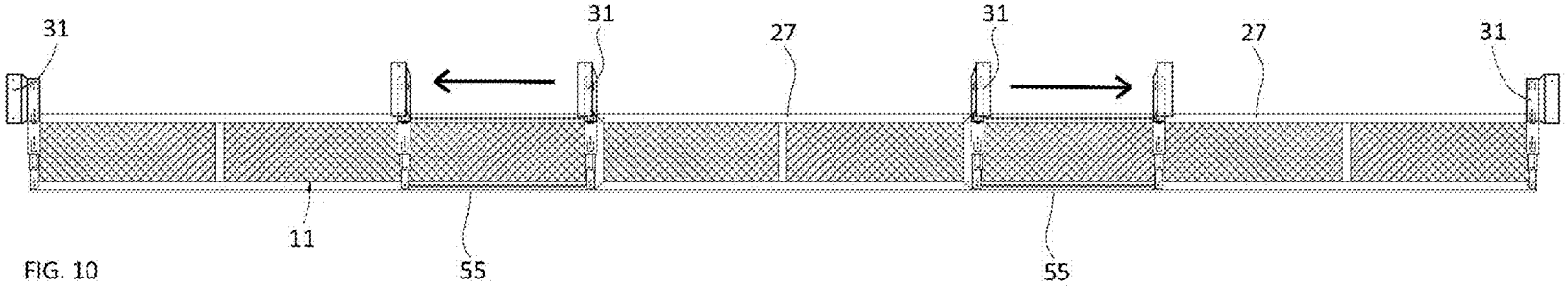
FIG. 10 is a perspective view of another alternative embodiment of a screen panel according to this patent application.

FIG. 10 shows another alternative embodiment, in which panel 11 comprises three frames 27 and two adjustable extensions 55. Extensions 55 span the width between frames 27 and are adjustable to allow for use of panel 11 on doors of various widths and for doors having various location of stiles.

Figure 11:
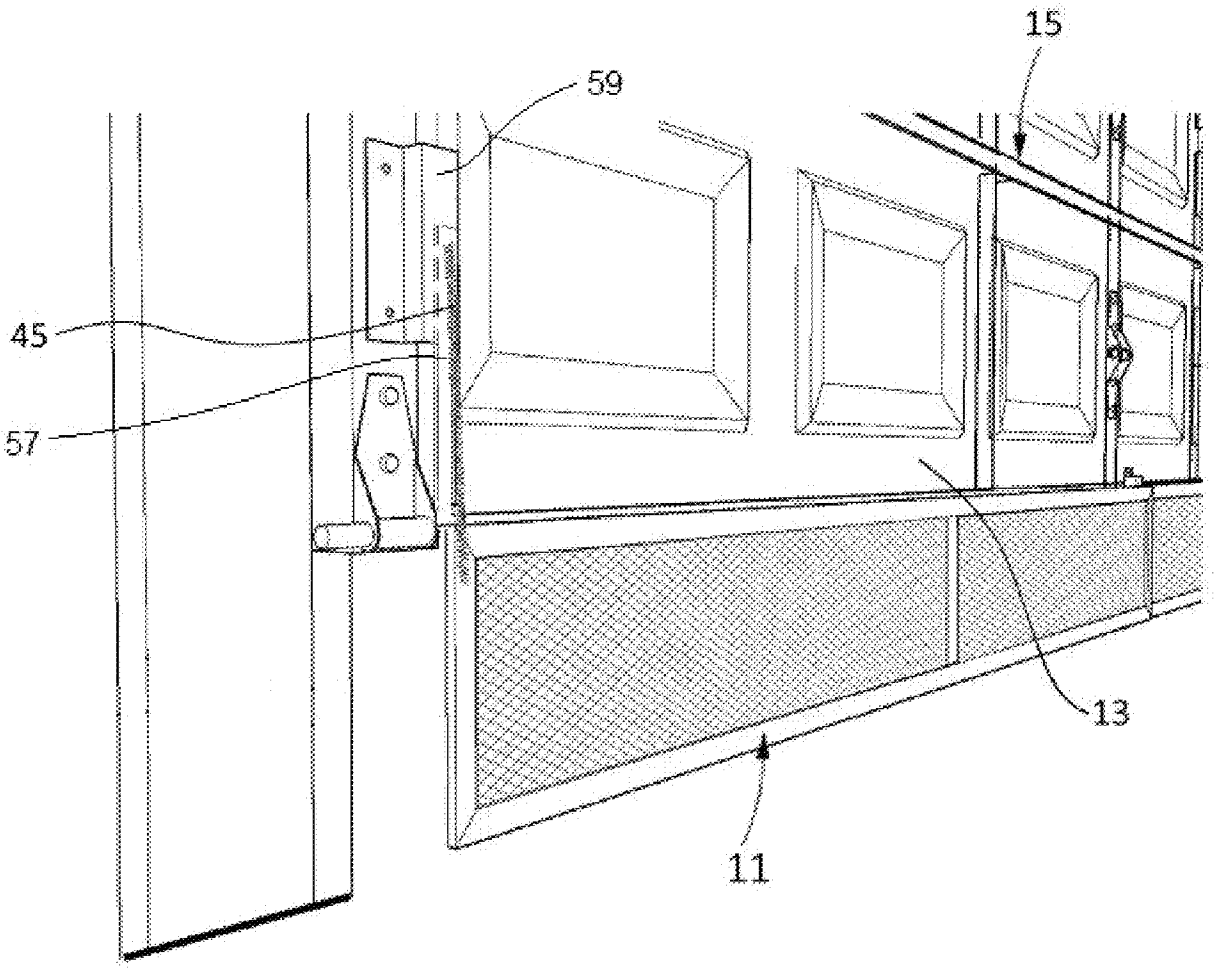
FIG. 11 is a perspective view of a portion of a garage door having another alternative embodiment of a screen panel installed.

Panel 11 can be coupled to door 15 using other common types of sliding configurations. For example, FIG. 11 shows another alternative embodiment, wherein each end (one shown) of panel 11 is coupled to bottom section 13 of door 15 with a solid bar 57 that is slidably captured within bracket 59. Bar 57 has a length that allows for panel 11 to move to the extended position shown and stiff enough that panel 11 is maintained in the generally parallel orientation relative to section 13. The length of bar 57 is selected so that bar 57 does not extend above the top of section 13 when panel 11 is moved to the retracted position, and a stop prevents bar 57 from sliding out of the bottom of bracket 59. Other embodiments include the use of slots or grooves, such as U-channel members, to couple panel 11 to door 15.

Figure 12:
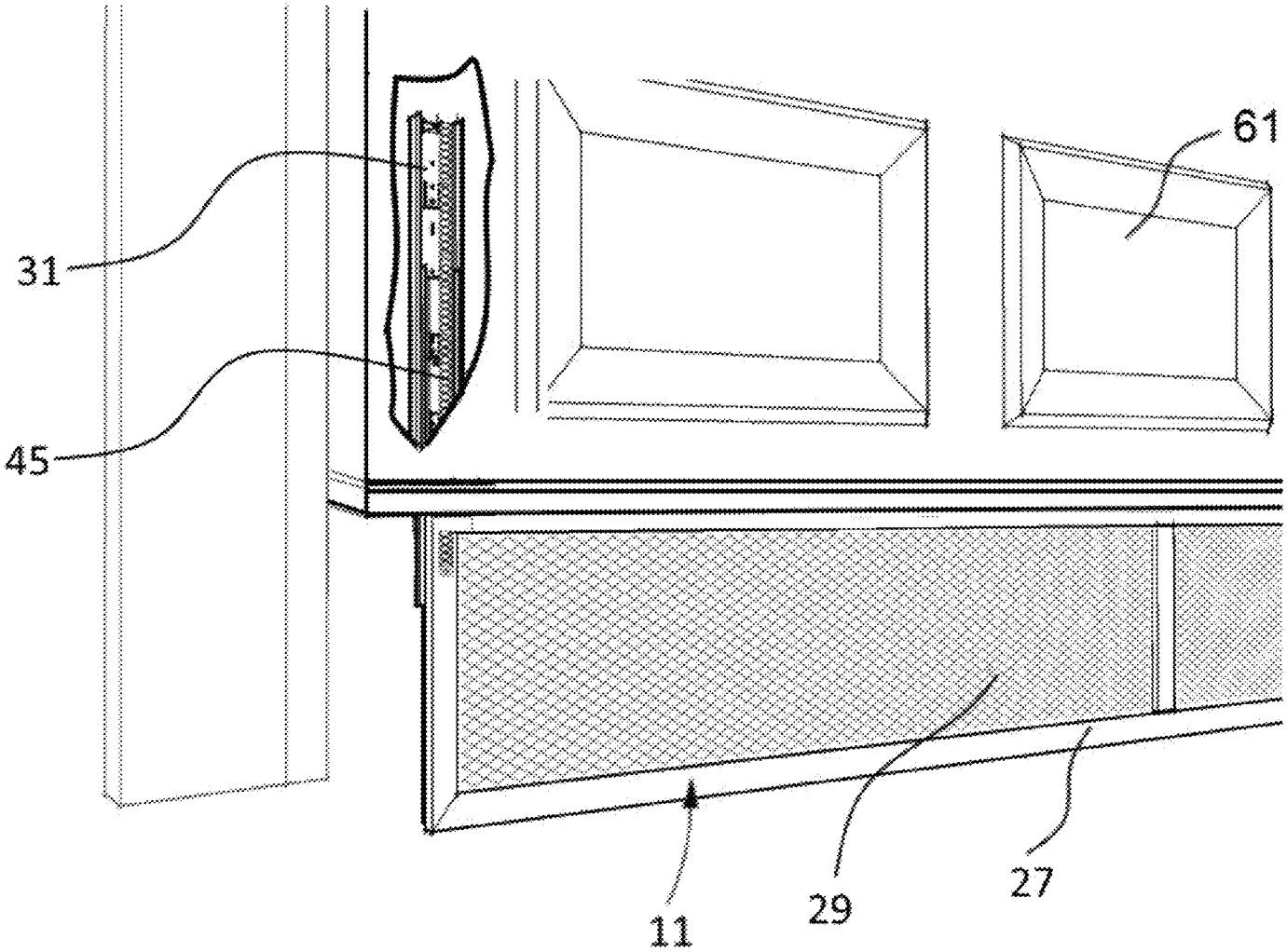
FIG. 12 is a perspective view of a portion of a garage door having another alternative embodiment of a screen panel installed.

While shown above as external to section 13, panel 11 can alternatively be installed within a bottom section of a door. FIG. 12 shows a panel 11 extending from within section 61 to the extended position, and panel 11 is fully within section 13 in the retracted position. With an enclosed section 61, panel 11 can be hidden from view when in the retracted position.

This patent application provides several significant advantages, including providing a garage door screen having a passive system for extension and retraction of the screen.

This patent application includes illustrative embodiments having a limited number of forms, and the embodiments are amenable to various changes and modifications without departing from the spirit thereof.

What is claimed is:

1. A screen panel for a roll-up door, comprising:

a screen panel configured to be slidably coupled to the roll-up door adjacent a bottom portion of the roll-up door, the screen panel configured to be generally parallel to the bottom portion of the roll-up door when installed and movable between a retracted position, wherein a bottom edge of the screen panel is configured to be generally aligned with a bottom edge of the roll-up door, and an extended position, wherein the bottom edge of the screen panel is configured to be located below the bottom portion; and a biasing device for biasing the screen panel toward the retracted position with a biasing force;

wherein the biasing force is sufficient to move the screen panel to the retracted position only when the screen panel is positioned in an orientation other than a vertical orientation.

2. The screen panel of claim 1, further comprising:

a locking device for selectively fixing the screen panel in the retracted position.

3. The screen panel of claim 1, wherein the biasing device is a spring.

4. A screen panel for a roll-up door, comprising:

a screen panel configured to be slidably coupled to the roll-up door at a bottom portion of the roll-up door, the screen panel configured to be generally parallel to the bottom portion of the roll-up door when installed and movable a limited distance between a retracted position, wherein a bottom edge of the screen panel is configured to be generally aligned with a bottom edge of the roll-up door, and an extended position, wherein the bottom edge of the screen panel is configured to be located below the bottom portion, wherein the screen panel is configured to be internal to the bottom section when in the retracted position; and a biasing device for biasing the screen panel toward the retracted position with a biasing force;

wherein the biasing force is insufficient to prevent the screen panel from moving to the extended position while the screen panel is in a vertical orientation, the biasing force being sufficient to move the screen panel to the retracted position when the screen panel is positioned in an orientation other than the vertical orientation.

5. The screen panel of claim 1, wherein the biasing device is a pneumatic strut.

6. The screen panel of claim 1, further comprising:

telescoping sliders configured for coupling the screen panel to the roll-up door.

7. The screen panel of claim 1, wherein the screen panel comprises multiple sections allowing for adjustable outer dimensions of the screen panel.

8. The screen panel of claim 1, wherein the width of the screen panel is adjustable.

9. The screen panel of claim 1, wherein the height of the screen panel is adjustable.

10. The screen panel of claim 1, wherein the screen panel is configured to be internal to the bottom section when in the retracted position.

11. A screen panel for a roll-up door, comprising:

a screen panel configured to be slidably coupled to the roll-up door at a bottom portion of the roll-up door, the screen panel configured to be generally parallel to the bottom portion of the roll-up door when installed and movable between a retracted position, wherein a bottom edge of the screen panel is configured to be generally aligned with a bottom edge of the roll-up door, and an extended position, wherein the bottom edge of the screen panel is configured to be located below the bottom portion; and a biasing device for biasing the screen panel toward the retracted position with a biasing force;

wherein the biasing force is insufficient to prevent the screen panel from moving to the extended position while the screen panel is in a vertical orientation, the biasing force being sufficient to move the screen panel to the retracted position when the screen panel is positioned in an orientation other than the vertical orientation.

12. The screen panel of claim 10, further comprising:

a locking device for selectively fixing the screen panel in the retracted position.

13. The screen panel of claim 10, wherein the biasing device is a spring.

14. The screen panel of claim 10, wherein the biasing device is a pneumatic strut.

15. The screen panel of claim 10, further comprising:

telescoping sliders configured for coupling the screen panel to the roll-up door.

16. The screen panel of claim 10, wherein the screen panel comprises multiple sections, thereby allowing for adjustable dimensions of the screen panel.

17. The screen panel of claim 10, wherein the width of the screen panel is adjustable.

18. The screen panel of claim 10, wherein the height of the screen panel is adjustable.

19. The screen panel of claim 18, further comprising:

telescoping sliders configured for coupling the screen panel to the roll-up door.

20. The screen panel of claim 18, wherein the biasing device is a spring.

21. The screen panel of claim 18, wherein the biasing device is a pneumatic strut.

* * * * *